United States Patent [19]

Weed

[11] Patent Number: 4,928,636

[45] Date of Patent: May 29, 1990

[54] EQUALIZER PORT

[75] Inventor: Lyle E. Weed, Fond du Lac, Wis.

[73] Assignee: Brunswick Corporation, Skokie, Ill.

[21] Appl. No.: 337,424

[22] Filed: Apr. 13, 1989

[51] Int. Cl.[5] ..... F02N 17/00

[52] U.S. Cl. ..... 123/73 R; 123/73 V; 137/855

[58] Field of Search ..... 123/65 R, 73 R, 73 D, 123/73 V, 73 A; 137/855, 856

[56] References Cited

U.S. PATENT DOCUMENTS

| | | | |
|---|---|---|---|
| 1,775,303 | 9/1930 | Baker | 123/73 D |
| 2,459,594 | 1/1949 | Smith | 123/73 V |
| 2,804,861 | 9/1957 | Heidner | 123/73 V |
| 4,509,472 | 4/1985 | Slattery | 123/73 R |

FOREIGN PATENT DOCUMENTS

| | | | |
|---|---|---|---|
| 649303 | 12/1928 | France | 123/73 V |
| 874530 | 8/1942 | France | 123/73 V |

*Primary Examiner*—David A. Okonsky

*Attorney, Agent, or Firm*—Lee, Mann, Smith, McWilliams & Sweeney

[57] ABSTRACT

A port for equalizing the pressure between crankcase compartments of a two-cycle internal combustion crankcase compression engine. In one form of the invention, the port is formed in a common web between the crankcase compartments. In another form of the invention, a pair of ports are located in a common reed block, each of the ports being in communication with one of the crankcase compartments.

15 Claims, 2 Drawing Sheets

Fig. 2.
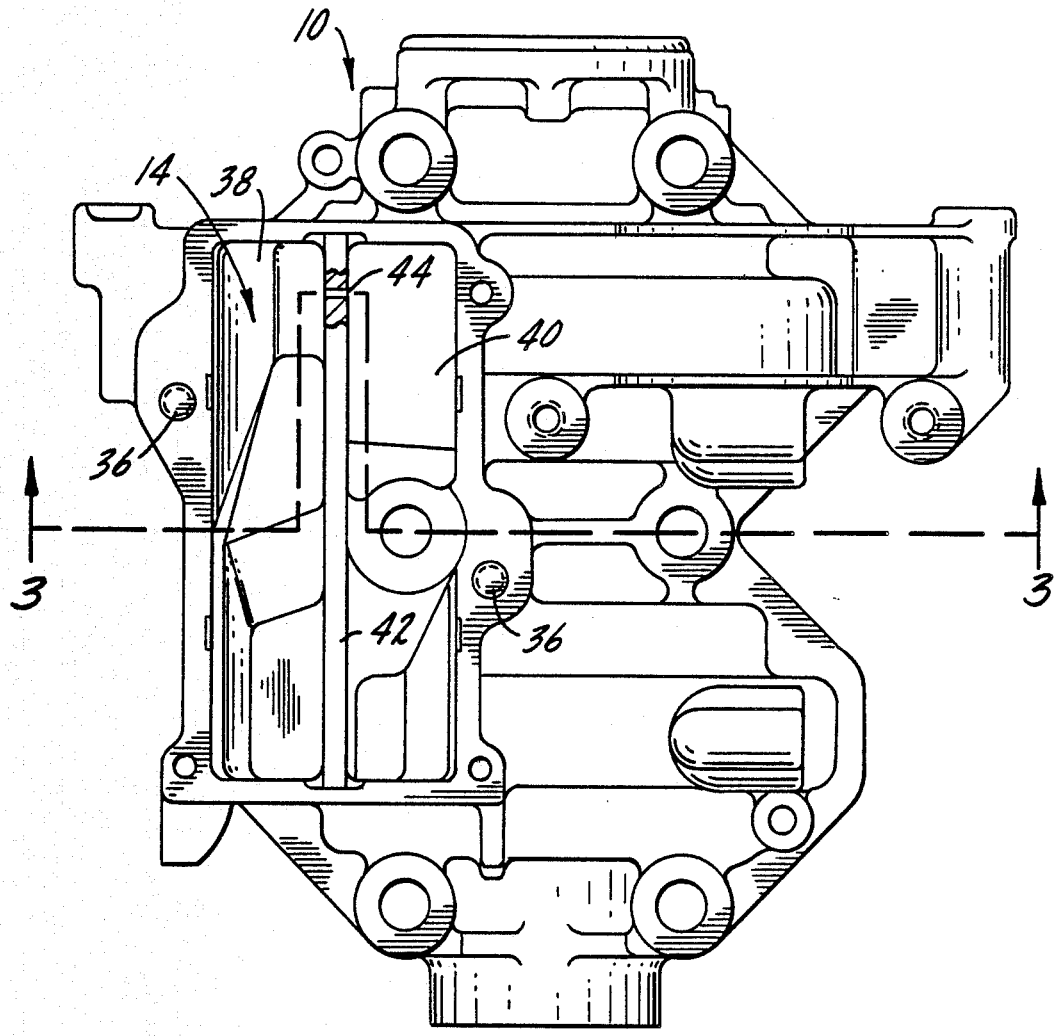
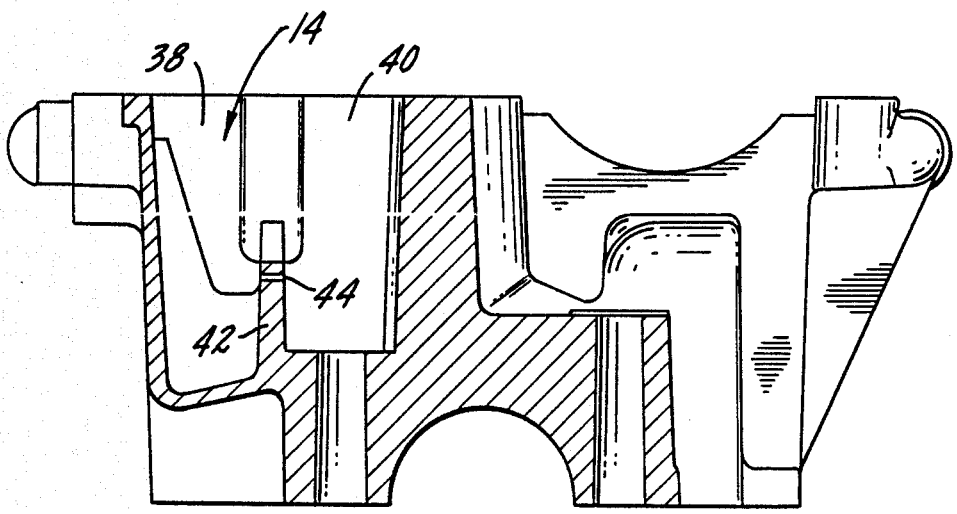
Fig. 3.

EQUALIZER PORT

BACKGROUND OF THE INVENTION

This invention relates to internal combustion crankcase compression engines, and in particular two means for eliminating popping or stalling of such engines at lower rpm's.

Two-cycle internal combustion crankcase compression engines are typical for marine outboard applications. In such engines, fuel, after passing through and being vaporized in the carburator, is passed into ssepa-rate crankcase compartments, each of the compartments being in communication with an individual cylinder of the engine. The fuel is compressed in each of the crankcase compartments before being introduced into the respective cylinder for combustion. In such engines, as exemplified by U.S. Pat. No. 4,244,332, introduction of vaporized fuel into the crankcase is controlled through a reed block assembly.

In smaller such engines, and in particular two cylinder engines having separate crankcase compartments serviced by a common reed block assembly, at low rpm's, the engines can experience what is known as "lean popping" or engine stalling when the engine is throttled back. Lean popping causes rather rough idling of the engine, and is due to unequal pressures between the two crankcase compartments.

In the past, lean popping has been eliminated by means of a dashpot assembly installed on the throttle of the engine to slow return of carburator controls for the engine upon rapid release of the throttle of reduction of the throttle position from a high throttle position to an idle position. Slowing return of the carburator controls prevents the unequal pressures which occur, thus eliminating lean popping or engine stalling at idle speeds.

One problem with a dashpot assembly is the obvious delay introduced during a rapid desired reduction of engine speed from a high throttle position to a speed at or near idle. Another concern is cost since the dashpot assembly does introduce additional components and complexity into the engine.

SUMMARY OF THE INVENTION

The present invention overcomes these disadvantages of the prior art and others by introducing means for communicating between crankcase compartments of a two-cycle internal combustion crankcase compression engine in order to equalize pressure between the compartments. The engine is a typical engine having a fuel induction system including at least two separate such crankcase compartments.

In accordance with a first form of the invention, the crankcase compartments are separated by a common web, and the means for equalizing the pressure comprises a port in the web. The port is a hole about 0.042 inches in diameter, the size being sufficient to equalize pressure between the crankcase compartments.

In accordance with a second form of the invention, in the common reed block separating and comprising an inlet into each crankcase compartment the means for equalizing pressure comprises a pair of ports in the reed block, each port being in communication with one of the crankcase compartments. As in the first form of the invention, each port is a hole about 0.042 inches in diameter.

BRIEF DESCRIPTION OF THE DRAWINGS

The invention is described in greater detail in the following description of examples embodying the best mode of the invention, taken in conjunction with the drawings figures, in which:

FIG. 2 is an enlarged top plan view of a crankcase cover according to the invention, showing separate crankcase compartments and, in cross section, an equalizing port according to the invention, FIG. 3 is a cross-sectional view taken along lines 3—3 of FIG. 1.

DESCRIPTION OF EXAMPLES EMBODYING THE BEST MODE OF THE INVENTION

Figure 1:
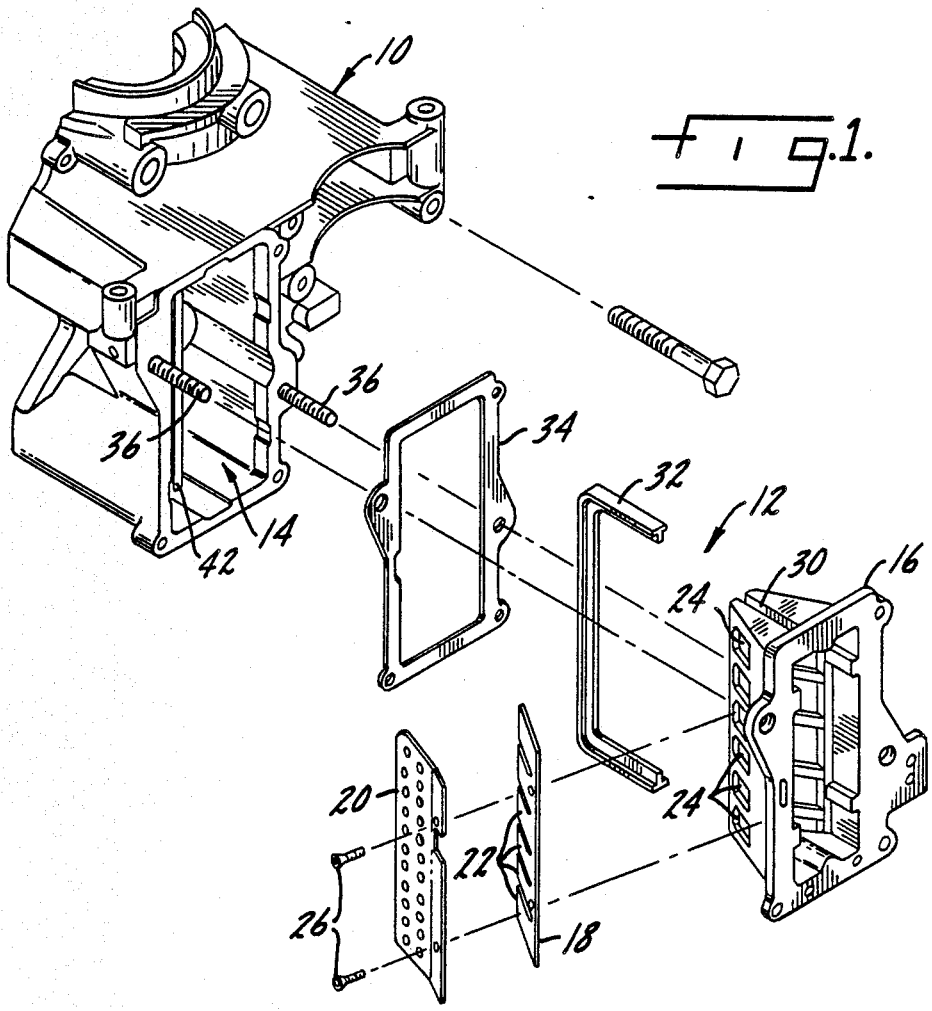
FIG. 1 is an exploded perspective view of a crankcase cover and reed block assembly according to the invention.
Figure 4:
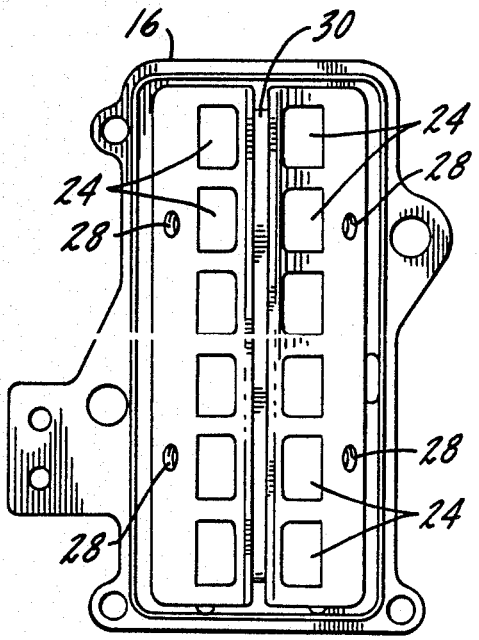
FIG. 4 is an enlarged elevational face view of a reed block according to the invention, when unassembled.

Illustrated in FIG. 1 is a crankcase cover 10 and portions of a reed block assembly 12 which are positioned to be installed within a crankcase inlet compartment 14 of the crankcase cover 10. The crankcase cover 10 is conventional, and is intended to be a part of a conventional two cylinder outboard motor, such as the Merc or Mariner 20 and 25 horsepower 2-cycle internal combustion crankcase compression engines manufactured by the Mercury Marine division, Fond du Lac, Wisconsin, of the Brunswich Corporation, Skokie, Ill. Thus, an entire outboard engine is not illustrated, it being understood that the engine is conventional.

The reed block assembly 12, which may also be conventional, comprises a reed block 16, a reed 18 and a reed stop 20 for each side of the reed block 16. The reed 18 includes a series of reed elements 22, each of which, when assembled on the reed block 16, is in alignment with an inlet 24 of the reed blcok 16. As shown in FIG. 1, the reed 18 and reed stop 20 are assembled to each side of the reed block 16 by means of a pair of bolts 26 which engage threaded aperatures 28 in the reed block 16.

The reed block 16 includes a channel 30 into which a corresponding seal 32 is fitted when the reed block assembly 12 is installed in the crankcase cover 10. Also, for proper sealing between the outer peripheral flange area of the reed blcok 16 and the crankcase cover 10, an appropriate gasket 34 is provided. As shown in FIG. 1, the assembled reed block assembly 12 and gasket 34 are mounted on the crankcase cover 10 by means of a pair of studs 36 installed in the crankcase cover 10 and other bolts (not illustrated) passing through appropriate aperatures in the peripheral flange area of the reed block 16 and being installed in aligned threaded aperatures in the crankcase cover 10. All such elements are conventional, and are not shown in detail.

Turning to FIGS. 2 and 3, the crankcase inlet compartment 14 of the crankcase cover 10 is composed of a pair of crankcase compartments 38 and 40, separated by a common web 42. When the reed block assembly 12 is installed in the crankcase inlet compartment 14, the seal 32 bears against the web 42 and the depending sides of the crankcase inlet compartment 14 between the crankcase comparatments 38 and 40, completely separating the crankcase compartments 38 and 40 from one another. Thus, instantaneous pressure in one of the crankcase compartments 38 and 40 is isolated from, and may be different from, instantaneous pressure in the other of the compartments 38 or 40. As a result, and as explained above, lean popping is a recurring problem. In order to equalize pressure between the compartments 38 and 40, an equalization port, in the form of a small hole 44 is located between the compartments 38 and 40. The hole is of sufficient size to permit equalization of pressure, and an optimal size of 0.042 inches has been found to be satisfactory for that purpose. The location of the hole 44 is preferably at least ½ inch from either end of the web 42.

Figure 5:
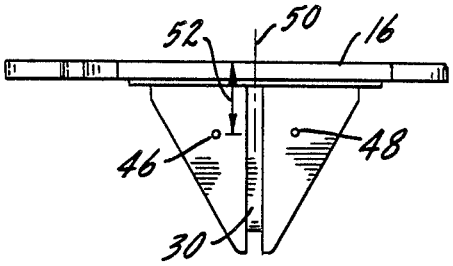
FIG. 5 is a top plan view of the reed block of FIG. 4, having a pair of equalizing ports according to the invention.

A second form of the equalization port according to the invention is shown in FIG. 5. In this form of the invention, a pair of holes 46 and 48 are located in the reed blcok 16, on opposite sides of the seal channel 30, and thus in communication with respective ones of the crankcase compartments 38 and 40. Similar to the hole 44, the holes 46 and 48 are preferably 0.042 inches in diameter. Each of the holes is preferably spaced approximately 0.375 inches from the center line 50 of the reed block 16, and is located a distance 52 approximately ⅝ inch from the inlet to the reed blcok 16.

The equalization port, whether in the form of the hole 44 or the pair of holes 46 and 48, provides a small relief passageway between the crankcase comparements 38 and 40. Thus, during normal operation of an outboard motor incorporating the crankcase cover 10 and either the hole 44 in the web 42, or the holes 46 and 48 in the reed block 16, unequal pressures which normally occur between the crankcase compartments 38 and 40 are substantially eliminated. Thus, the previous problems of "lean popping" or stalling at idle are eliminated.

Various changes can be made to the invention without departing from the spirit thereof or scope of the following claims.

What is claimed is:

1. In a two-cycle internal combustion crankcase compression engine having a fuel induction system including at least two separate crankcase compartments and a reed block shared by and separating at least two of the crankcase compartments, the reed block having an inlet into each shared compartment, the improvement comprising means communicating between the crankcase compartments for equalizing pressure between the compartments.

2. An engine according to claim 1 in which said shared compartments are separated also by a common web, and in which said means communicating comprises a port in said web.

3. An engine according to claim 2 in which said port is a hole about 0.042 inches in diameter.

4. An engine according to claim 1 including two of said compartments, and in which said means communicating comprises a pair of ports in said reed block, each port being in communication with one of said compartments.

5. An engine according to claim 4 in which each said port is a hole about 0.042 inches in diameter.

6. In a two-cycle internal combustion crankcase compression engine having a fuel induction system including a pair of separate crankcase compartments separated by a common web, and a reed block shared by the crankcase compartments, the reed block extending from the web and having an inlet into each crankcase compartment, the improvement comprising means communicating between the crankcase compartments for equalizing pressure between the compartments.

7. An engine according to claim 6 in which said means communicating comprises a port in said web.

8. An engine according to claim 7 in which said port is a hole about 0.042 inches in diameter.

9. An engine according to claim 6 in which said means communicating comprises a pair of ports in said reed block, each port being in communication with one of said compartments.

10. An engine according to claim 9 in which said port is a hole about 0.042 inches in diameter.

11. A two-cycle combustion crankcase compression engine comprising:

(a) a fuel induction system having a pair of separate crankcase compartments each supplying fuel to a separate cylinder of the engine, (b) a common web separating said compartments, (c) a reed block shared by said compartments, said reed block extending from the web and having an inlet into each said compartment, and (d) means communicating between said crankcase compartments for equalizing pressure between said compartments.

12. An engine according to claim 11 in which said means communicating comprises a port in said web.

13. An engine according to claim 12 in which said port is a hole about 0.042 inches in diameter.

14. An engine according to claim 11 in which said means communicating comprises a pair of ports in said reed block, each port being in communication with one of said compartments.

15. An engine according to claim 14 in which each said port is a hole about 0.042 inches in diameter.

* * * * *